US007146968B2

(12) United States Patent
Koito et al.

(10) Patent No.: US 7,146,968 B2
(45) Date of Patent: Dec. 12, 2006

(54) IN-LINE TYPE FUEL SUPPLY DEVICE IN FUEL INJECTION DEVICE

(75) Inventors: Yasuhiro Koito, Kawasaki (JP); Hidefumi Yoshida, Kawasaki (JP)

(73) Assignee: Keihin Corporation, Tokyo (JP)

( * ) Notice: Subject to any disclaimer, the term of this patent is extended or adjusted under 35 U.S.C. 154(b) by 0 days.

(21) Appl. No.: 11/377,248

(22) Filed: Mar. 17, 2006

(65) Prior Publication Data

US 2006/0207574 A1 Sep. 21, 2006

(30) Foreign Application Priority Data

Mar. 17, 2005 (JP) ..... 2005-077002

(51) Int. Cl.
*F02M 37/04* (2006.01)
*F02M 37/20* (2006.01)

(52) U.S. Cl. ..... 123/509; 123/516

(58) Field of Classification Search ..... 123/509, 123/510, 511, 514, 516
See application file for complete search history.

(56) References Cited

U.S. PATENT DOCUMENTS 4,571,159 A * 2/1986 Beardmore ..... 417/366
5,103,793 A * 4/1992 Riese et al. ..... 123/516
5,146,901 A * 9/1992 Jones ..... 123/516
5,482,021 A * 1/1996 Roche ..... 123/456
5,908,020 A * 6/1999 Boutwell et al. ..... 123/541
6,298,832 B1 * 10/2001 Yamazoe et al. ..... 123/514
6,357,424 B1 * 3/2002 Sonoda et al. ..... 123/509
6,401,750 B1 * 6/2002 Tokunaga ..... 137/565.34
6,491,029 B1 * 12/2002 Kondou et al. ..... 123/509
6,494,184 B1 * 12/2002 Nawa et al. ..... 123/470
6,604,512 B1 * 8/2003 Kato ..... 123/509
6,823,831 B1 * 11/2004 Chu et al. ..... 123/198 D
6,932,177 B1 * 8/2005 Hara et al. ..... 180/219

* cited by examiner

*Primary Examiner*—Thomas Moulis
(74) *Attorney, Agent, or Firm*—Bacon & Thomas, PLLC

(57) ABSTRACT

In an in-line type fuel supply device suitable for a motorcycle, a fuel flow-in chamber 7 with a fuel flow-in passage 2 is formed at a bottom portion 1*a* of a first case body 1, and a pump intake passage 55 is opened in the fuel flow-in chamber 7, a pump discharge passage 56 is inserted into a discharge passage inserting hole 8*a* of a second support member 8 connected to a fuel discharge passage 4, a relief passage 9 comprising a relief valve is opened toward a cylindrical space 14, a vapor discharge passage 5 is opened in the cylindrical space 14, a fuel flow-in passage 5 is connected to a fuel tank with a pipe 15, a fuel discharge passage 4 is connected to a fuel injection valve with a pipe 16, and a vapor discharge passage 5 is connected to the fuel tank with a pipe 17.

2 Claims, 3 Drawing Sheets

IN-LINE TYPE FUEL SUPPLY DEVICE IN FUEL INJECTION DEVICE

BACKGROUND OF THE INVENTION

1. Field of the Invention

The present invention relates to a fuel injection device, in which fuel in a fuel tank is increased in pressure by a motor-driven fuel pump, and the fuel increased in pressure is supplied toward a fuel injection valve.

2. Description of the Conventional Art

A conventional fuel supply device using a fuel pump is illustrated in FIG. 3.

In FIG. 3, T is a fuel tank storing fuel therein, and a fuel pump P is fixed and provided in the fuel tank T through a support member such as a stay or the like.

The fuel pump P is formed with a pump portion 51 and a motor portion 52 for rotating and driving the pump portion 51 in a housing 50. As for the pump portion 51, an impeller 54 is rotatably provided in a pump chamber 53, and a pump intake passage 55 is opened in the pump chamber 53.

Further, when the impeller 54 is rotated by rotating the motor portion 52, the fuel is increased in pressure in the pump chamber 53, the fuel sucked from the pump intake passage 55 into the pump chamber 53 passes through an outer circumference of the motor portion 52, and is supplied toward an fuel injection valve J from a pump discharge passage 56 opened on an upper end.

On the other hand, a relief valve R is provided at the fuel pump P. Here, an inner part and the outside of the housing 50 are connected with a relief passage 57 and the relief valve R is provided in a relief passage 57.

The relief valve R is necessary to prevent damaging of the fuel pipe and leaking of the fuel, when a fuel pipe on the downstream side is closed, in which the fuel pipe is connected from the pump discharge passage 56 to the fuel injection valve J. The relief valve R opens the relief passage 57 at a fuel pressure being more than a fixed pressure, discharges the fuel pressure in the fuel pipe toward into the fuel tank T, and prevents increasing of abnormal pressure in the fuel pipe.

As the fuel pump P is provided in the fuel tank T, such the fuel supply device is generally called as an in-tank type fuel supply device.

SUMMARY OF THE INVENTION

When such the conventional in-tank type fuel supply device is used for a motorcycle, it is necessary to house and provide the fuel pump in the fuel tank. Thus, this device is hardly used for the motorcycle, in which a fuel tank capacity is smaller than that of an automobile and an appearance shape is greatly influenced by the device.

From the above-described view points, an in-line type fuel supply device in which the fuel pump is provided at the outside of the fuel tank has been used for the motorcycle. However, in order to adopt the in-line type fuel supply device for motorcycle, it is necessary to consider piping between a fuel intake passage and a fuel tank, piping between a pump discharge passage and a fuel injection valve, piping between a relief passage and a fuel tank, and discharging of vapor which is generated in a pipe connected from the fuel tank toward the fuel pump.

The present invention solves the above-described problems, and an objective of the present invention is to provide an in-line type fuel supply device which is suitably used for a motorcycle.

One aspect of the in-line type fuel supply device in the fuel injection device of the present invention to obtain the above-described objective, where fuel in a fuel tank is increased in pressure by a fuel pump provided at the outside of the fuel tank and the fuel increased in pressure is supplied toward a fuel injection valve in the fuel injection device has a following constitution. A pump housing case body is formed with a bottomed cup shaped first case body and a bottomed cup shaped second case body. A fuel pump is held by a first support member and a second support member, where the first support member faces to a lower bottom portion of the first case body, and the second support member faces to an upper bottom portion of the second case body, and the fuel pump is supported in such manner as having a cylindrical space at the pump housing case body. A pump intake passage of the fuel pump is formed by the lower bottom portion of the first case body and the first support member, and is provided in a fuel flow-in chamber, in which a fuel flow-in passage is opened, through a strainer. A pump discharge passage of the fuel pump is inserted and provided in a discharge passage inserting hole provided at the second support member and connected to a fuel discharge passage, which is opened from the second case body to the outside. Further, a vapor discharge passage and a relief passage are opened in the cylindrical space. The vapor discharge passage is formed at the second case body and one end of this passage is opened toward the outside. The relief passage is formed at the second support member and one end of this passage is opened toward the discharge passage inserting hole. Furthermore, a relief valve is provided at the relief passage, so as to open the relief passage toward the cylindrical space when a pressure in the discharge passage inserting hole including the fuel discharge passage is more than a fixed pressure.

Further, in addition to the above-described aspect, another aspect of the present invention is that the second support member is integrally formed with the second case body.

According to the one aspect of the present invention, the fuel in the fuel tank is supplied into the fuel flow-in chamber through the fuel flow-in passage. The fuel in the fuel flow-in chamber is sucked into the pump portion through the strainer and the pump intake passage. Further, the fuel increased in pressure in the pump portion is supplied to the fuel injection valve through the pump discharge passage, the discharge passage inserting hole and the fuel discharge passage.

Further, the vapor entering into the fuel flow-in chamber is returned to the fuel tank from the vapor discharge passage through the cylindrical space.

Furthermore, when the fuel pressure in the discharge passage inserting hole including the fuel discharge passage is increased to the pressure being more than the fixed pressure, the relief valve opens the relief passage, and the fuel is returned to the fuel tank through the cylindrical space and the vapor discharge passage.

Accordingly, since the relief fuel from the relief passage is discharged by using the vapor discharge passage provided in the in-line type fuel supply device, it is not necessary to provide a new relief discharge pipe toward the fuel tank, so that this device is effective for a machine such as the motorcycle having a limited space of mounting equipments and pipes.

Further, the relief valve is provided at a member being different from the fuel pump, so that it is easily to carry out a maintenance operation when the relief valve is stuck or catches a foreign matter.

Further, the relief passage of the relief valve is provided at a passage on the downstream side from an outlet of the pump discharge passage. When the abnormal pressure is generated, the pressure can be relieved before the abnormal pressure acts on the fuel pump P, so that the abnormal pressure does not act on the motor portion in the fuel pump.

Furthermore, according to the other aspect of the present invention, the second support member comprising the relief valve is integrally formed with the second case body, so that the number of parts and assembling processes can be reduced. Thus, it is effective for reducing a product cost.

DETAILED DESCRIPTION OF PREFERRED EMBODIMENT

Figure 1:
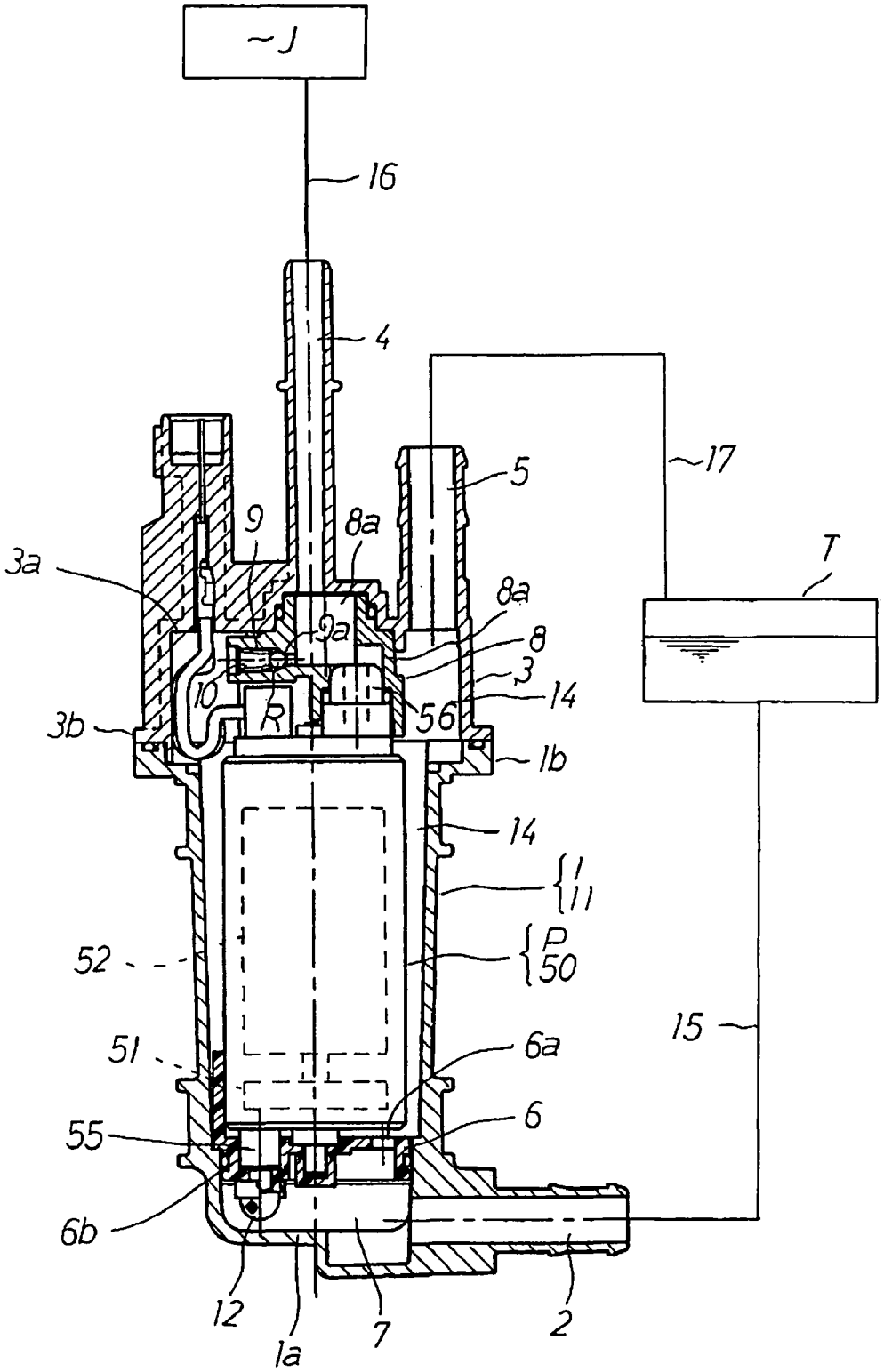
FIG. 1 is a longitudinal sectional view illustrating first example of an in-line type fuel supply device in a fuel injection device of the present invention.

Hereinafter, one example of the in-line type fuel supply device according to the present invention will be described with FIG. 1.

Figure 3:
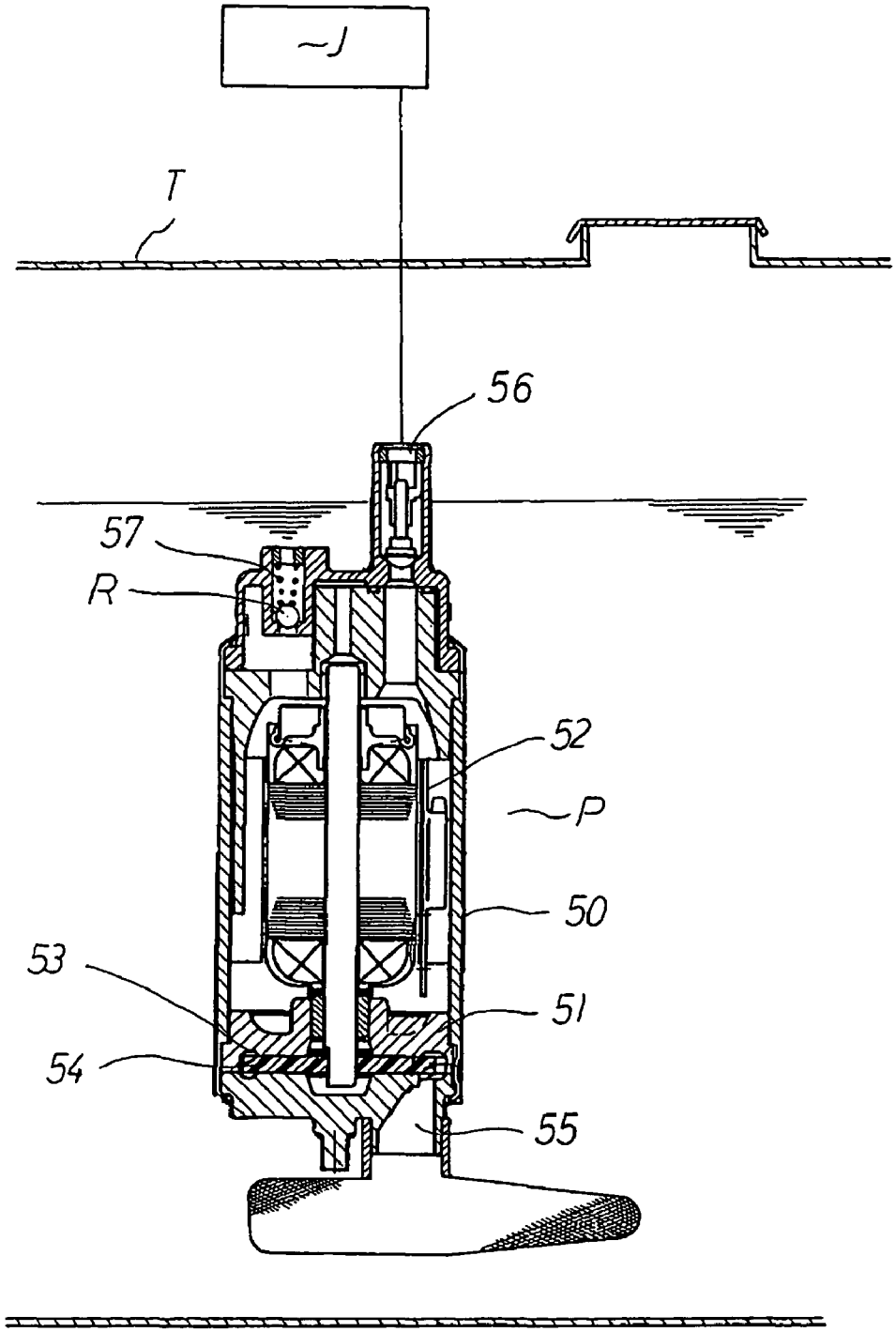
FIG. 3 is a longitudinal sectional view illustrating a conventional in-line type fuel supply device.

The fuel pump P has a same structure as that of FIG. 3, so that same codes are used and descriptions are omitted.

Reference numeral 1 is a first case body in a bottomed cup shape, which has a lower bottom portion 1*a* at a lower part thereof, and an upper part of this body is upwardly opened at an upper flange portion 1*b*. A fuel flow-in passage 2 is opened near the lower bottom portion 1*a* toward the side direction.

Reference numeral 3 is a second case body having an upper bottom portion 3*a* at an upper part thereof, and a lower part is opened downwardly at a lower flange portion 3*b*. On the upper bottom portion 3*a*, a fuel discharge passage 4 and a vapor discharge passage 5 are opened upwardly.

Reference numeral 6 is a first support member provided on a locking step portion 1*c* formed at a lower part of the first case body. A fuel flow-in chamber 7 is formed at the lower part of the first case body 1 by the lower side surface of the first support member 6 and the lower bottom portion 1*a* of the first case body 1. Further, a vapor extraction hole 6*a* and an intake passage inserting hole 66 are provided at the first support member, where the vapor extraction hole 6*a* is opened upwardly, and the intake passage inserting hole 66 is for inserting a pump intake passage 55.

In addition, the fuel flow-in passage is opened in the fuel flow-in chamber 7.

Reference numeral 8 is a second support member provided at the upper bottom portion 3*a* of the second case body 2. A discharge passage inserting hole 8*a* is provided to be opened downwardly at the second support member 8, and an upper part of the discharge passage inserting hole 8*a* is connected to the fuel discharge passage 4 and opened.

Further, a relief passage 9 is provided to be opened toward the left side direction from the discharge passage inserting hole 8*a*, and a relief valve seat 9*a* facing to the left side direction and a relief valve R for opening/closing the relief valve seat 9*a* are provided at the relief passage 9.

The relief valve R is a normally closed valve, which is elasticity energized to the relief valve seat 9*a* by a relief spring 10. The relief valve R opens the relief passage 9 against spring force of the relief spring 10 when the pressure in the discharge passage inserting hole 8*a* becomes 540 kPa or more.

Further, the upper flange portion 1*b* of the first case body 1 and the lower flange portion 3*b* of the second case body 3 are contacted and fixed by screwing and thereby, a pump housing case body 11 is formed in a sealing state. At this time, the fuel pump P is provided in the pump housing case body 11, and is held and supported by the first support member 6 and the second support member 8.

Further, while keeping this state, the fuel intake passage 55 of the fuel pump P is opened from the intake passage inserting hole 6*b* of the first support member 6 to the fuel flow-in chamber 7, and strainer 12 provided in the fuel flow-in chamber 7 is mounted on the opening of the pump intake passage 55.

Further, the pump discharge passage 56 projected from an upper end of the fuel pump P is inserted and connected into the discharge passage inserting hole 8*a* of the second support member 8.

In addition, the relief passage 9 opened in the discharge passage inserting hole 8*a* is not closed by the pump discharge passage 56.

Further, a cylindrical space 14 is formed between the fuel pump P and the pump housing case body 11. The vapor extraction hole 6*a* of the first support member 6 is opened in a lower part of the cylindrical space 14, and the relief passage 9 and the vapor discharge passage 5 are opened in an upper part of the cylindrical space 14.

Further, the fuel flow-in passage 2 is connected to the fuel tank T with a first pipe 15. The fuel discharge passage 4 is connected to a fuel injection valve J with a second pipe 16. The vapor discharge passage 5 is connected to the fuel tank T with a third pipe 17.

According to the in-line type fuel supply device of the present invention having the above-described structure, the fuel in the fuel tank T is supplied into the fuel flow-in chamber 7 through the first pipe 15 and the fuel flow-in passage 2, and the fuel in the fuel flow-in chamber 7 is sucked into the pump portion 51 through the strainer 12 and the pump intake passage 55. Further, the fuel increased in pressure by the pump portion 51 is supplied to the fuel injection valve J through the pump discharge passage 56, the discharge passage inserting hole 8*a*, the fuel discharge passage 4 and the second pipe 16.

On the other hand, bubbles floating in the fuel in the fuel tank T and the vapor generated by heating of the first pipe 15 flow into the fuel flow-in chamber 7 together with the fuel flowing from the fuel flow-in passage 2. However, the bubbles and the vapor flowing into the fuel flow-in chamber 7 enter into the cylindrical space 14 from the vapor extraction hole 6*a* of the first support member 6 by a self buoyant. Further, the bubbles and the vapor are returned into the fuel tank T through the upper part of the cylindrical space 14, the vapor discharge passage 5 and the third pipe 17.

In this case, when the second pipe 16, the fuel injection valve J or the like is closed by some problems while the fuel pump P is driven, the fuel discharge pressure is remarkably increased as compared with an usual pressure, for example, 294 kPa, and sometime increased to the fuel pressure having the shutoff pressure of 540 kPa or more.

Further, the remarkably increased fuel pressure acts on the fuel discharge passage 4 and the discharge passage inserting hole 8*a*. When the remarkably increased fuel pressure acts on the relief passage 9 opened in the discharge passage inserting hole 8*a*, the relief valve R opens the relief valve seat 9*a* immediately against the spring force of the relief spring 10, to thereby reduce the increased pressures of the second pipe 16, the fuel discharge passage 4 and the discharge passage inserting hole 8*a* to the original pressure. Thereby, it can be prevented to damage the fuel pipe and leak the fuel in the second pipe 16 or the like.

Further, the fuel discharged from the relief passage 9 is returned into the fuel tank T through the cylindrical space 14, the vapor discharge passage 5 and the third pipe 17.

As described above, according to the present invention, when the fuel pressure in the second pipe 16 is increased to the fixed pressure or more, the fuel discharged from the relief passage 9 is discharged into the fuel tank T through the cylindrical space 14, the vapor discharge passage 5 and the third pipe 17, so that the above structure (the cylindrical space 14, the vapor discharge passage 5, the third pipe 17) used in the in-line pump can be effectively used. Thus, a special structure for returning the relief fuel to the fuel tank is not necessary.

Further, the relief valve R including the relief valve seat 9*a* is provided at the second support member 8. In such a structure, when the relief valve seat 9*a* catches a foreign matter or the relief valve R is stuck, the second support member 8 is removed from the second case body 3, to thereby easily check and clean those. So, the maintenance ability can be remarkably enhanced.

Further, the relief passage 9 is opened toward the discharge passage inserting hole 8*a*. In such a structure, when the pressure of the second pipe 16 is increased to be more than the fixed pressure, the increased pressure can be relived on the downstream side of the pump discharge passage 56. Thus, the increased fuel pressure does not act on the inside of the fuel pump P through the pump discharge passage 56 and thereby, there is no problem that components of the fuel pump P, such as the motor portion 52 or the like, are damaged.

Figure 2:
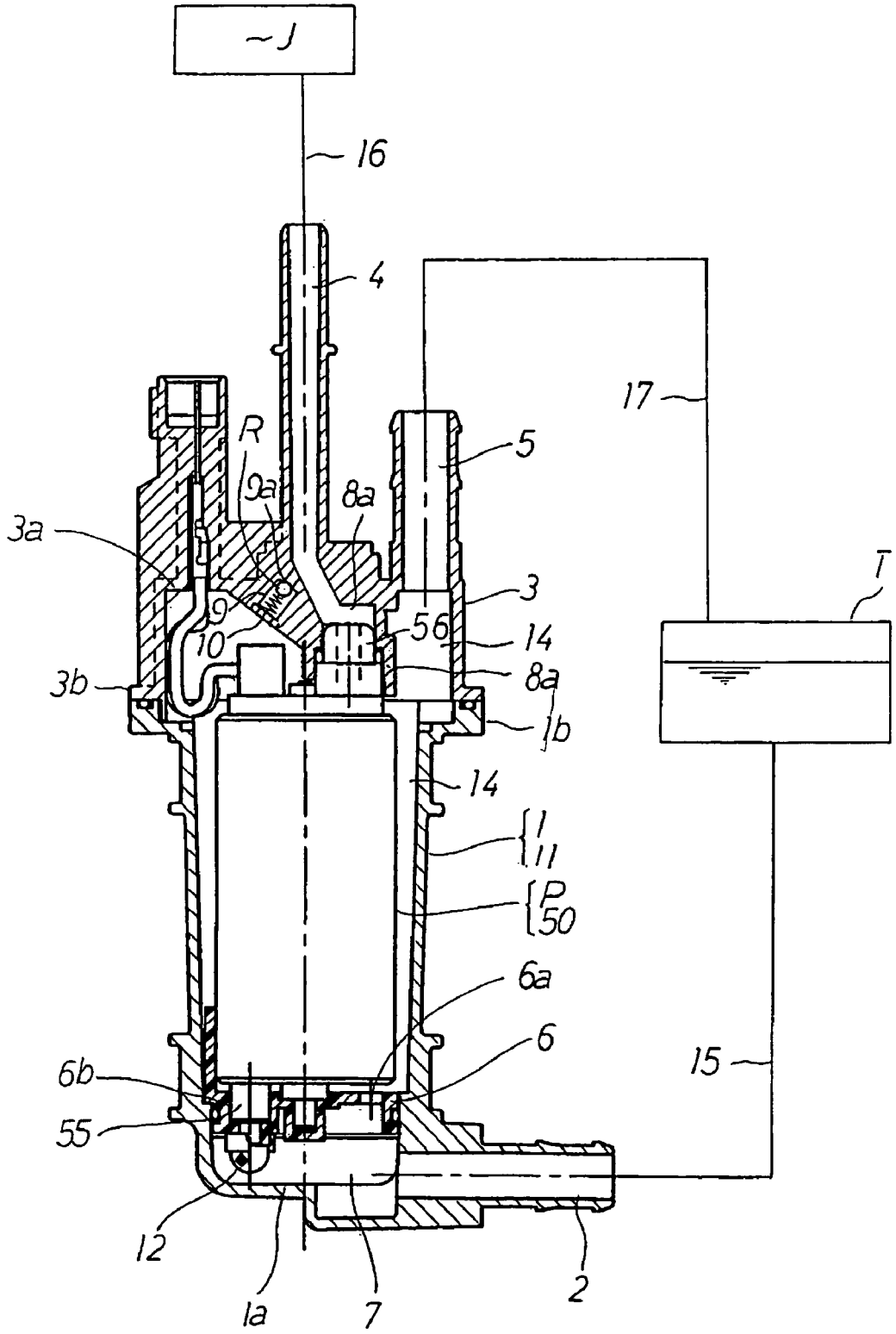
FIG. 2 is a longitudinal sectional view illustrating second example of an in-line type fuel supply device in a fuel injection device of the present invention.

FIG. 2 illustrates a second example of the present invention.

In FIG. 2, the second support member in the first example is integrally formed with the second case body 3.

As for same components of the second support member 8 as those in the first example, same reference codes are used and the descriptions are omitted.

According to this example, the action is same as that of the first example. However, since the second support member is integrally formed with the second case body, the number of parts and assembling processes can be reduced, so that it is effective to reduce the product cost.

What is claimed is:

1. An in-line type fuel supply device in a fuel injection device, in which fuel in a fuel tank is increased in pressure by a fuel pump provided at the outside of the fuel tank and the fuel increased in pressure is supplied toward a fuel injection valve in the fuel injection device, wherein a pump housing case body is formed with a bottomed cup shaped first case body and a bottomed cup shaped second case body;

wherein a fuel pump is held by a first support member and a second support member, where the first support member faces to a lower bottom portion of the first case body, and the second support member faces to an upper bottom portion of the second case body, and the fuel pump is supported in such manner as having a cylindrical space at the pump housing case body;

wherein a pump intake passage of the fuel pump is formed with the lower bottom portion of the first case body and the first support member, and provided in a fuel flow-in chamber, in which a fuel flow-in passage is opened, through a strainer;

wherein a pump discharge passage of the fuel pump is inserted and provided in a discharge passage inserting hole provided at the second support member and connected to a fuel discharge passage, which is opened from the second case body to the outside;

wherein a vapor discharge passage and a relief passage are opened in the cylindrical space, in which the vapor discharge passage is formed at the second case body, one end of the vapor discharge passage is opened toward the outside, the relief passage is formed at the second support member, and one end of the relief passage is opened toward the discharge passage inserting hole; and wherein a relief valve is provided at the relief passage, so as to open the relief passage toward the cylindrical space when a pressure in the discharge passage inserting hole including the fuel discharge passage is more than a fixed pressure.

2. The in-line type fuel supply device in the fuel injection device as claimed in claim 1, wherein the second support member is integrally formed with the second case body.

* * * * *